US008802343B2

(12) United States Patent
Tsurumi et al.

(10) Patent No.: US 8,802,343 B2
(45) Date of Patent: Aug. 12, 2014

(54) CARRIER FOR DEVELOPING ELECTROSTATIC CHARGE IMAGE, DEVELOPER FOR DEVELOPING ELECTROSTATIC CHARGE IMAGE, DEVELOPER CARTRIDGE FOR DEVELOPING ELECTROSTATIC CHARGE IMAGE, PROCESS CARTRIDGE, IMAGE FORMING APPARATUS, AND IMAGE FORMING METHOD

(75) Inventors: Yosuke Tsurumi, Kanagawa (JP); Norihito Fukushima, Kanagawa (JP); Yasuaki Hashimoto, Kanagawa (JP); Shintaro Anno, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 355 days.

(21) Appl. No.: 13/040,835

(22) Filed: Mar. 4, 2011

(65) Prior Publication Data

US 2012/0064452 A1 Mar. 15, 2012

(30) Foreign Application Priority Data

Sep. 9, 2010 (JP) ..... 2010-201883

(51) Int. Cl.
*G03G 9/00* (2006.01)

(52) U.S. Cl.
USPC ..... 430/111.33; 430/111.31

(58) Field of Classification Search
USPC ..... 430/111.31, 111.32, 111.33
See application file for complete search history.

(56) References Cited

U.S. PATENT DOCUMENTS

| | | | | |
|---|---|---|---|---|
| 6,534,232 | B1 * | 3/2003 | Matsuda et al. | 430/111.32 |
| 2002/0177060 | A1 * | 11/2002 | Matsuda et al. | 430/111.1 |
| 2007/0003858 | A1 * | 1/2007 | Akazawa et al. | 430/124 |
| 2007/0048646 | A1 * | 3/2007 | Sasaki et al. | 430/109.4 |
| 2008/0070144 | A1 * | 3/2008 | Nagatomo et al. | 430/109.4 |
| 2008/0199799 | A1 * | 8/2008 | Tsurumi et al. | 430/110.2 |
| 2009/0061333 | A1 | 3/2009 | Matsumoto et al. | |
| 2011/0070540 | A1 * | 3/2011 | Vanbesien et al. | 430/109.4 |

FOREIGN PATENT DOCUMENTS

| | | |
|---|---|---|
| EP | 0 449 541 A1 | 10/1991 |
| JP | A-03-276167 | 12/1991 |
| JP | A 2001-194833 | 7/2001 |
| JP | A 2002-244355 | 8/2002 |
| JP | A 2007-279588 | 10/2007 |
| JP | A-2008-122444 | 5/2008 |
| JP | A-2009-053545 | 3/2009 |

OTHER PUBLICATIONS

Mar. 11, 2014 Notice of Reasons for Rejection issued in Japanese Patent Application No. 2010-201883 (with translation).

* cited by examiner

*Primary Examiner* — Stewart Fraser
(74) *Attorney, Agent, or Firm* — Oliff PLC

(57) ABSTRACT

A carrier for developing an electrostatic charge image comprising a core material and a coating resin layer that covers the core material, wherein the core material is a ferrite particle having a Brunauer-Emmitt-Teller (BET) specific surface area of from about 0.12 $m^2/g$ to about 0.20 $m^2/g$, and having a fluidity of from about 26 sec/50 g to about 30 sec/50 g.

17 Claims, 2 Drawing Sheets

CARRIER FOR DEVELOPING ELECTROSTATIC CHARGE IMAGE, DEVELOPER FOR DEVELOPING ELECTROSTATIC CHARGE IMAGE, DEVELOPER CARTRIDGE FOR DEVELOPING ELECTROSTATIC CHARGE IMAGE, PROCESS CARTRIDGE, IMAGE FORMING APPARATUS, AND IMAGE FORMING METHOD

CROSS-REFERENCE TO RELATED APPLICATIONS

This application is based on and claims priority under 35 USC 119 from Japanese Patent Application No. 2010-201883 filed on Sep. 9, 2010.

BACKGROUND

1. Technical Field

The present invention relates to a carrier for developing an electrostatic charge image, a developer for developing an electrostatic charge image, a developer cartridge for developing an electrostatic charge image, a process cartridge, an image forming apparatus, and an image forming method.

2. Related Art

Methods for visualizing image information through an electrostatic latent image, such as electrophotography methods, are now utilized in a variety of fields. In an electrophotography method, an electrostatic latent image, which is formed on an image holding body via a charging process and a light exposure process, is visualized via development by a developer containing a toner, a transfer process and a fixing process. As developers used for development, there are two-component developers which contain a toner and a carrier, and one-component developers in which only a toner, for example, a magnetic toner or the like, is used. As the carrier used for the two-component developers, carriers having a core material and a coating resin layer that covers the core material with a resin are widely used nowadays.

SUMMARY

According to an aspect of the invention, there is provided a carrier for developing an electrostatic charge image comprising ferrite particles and a coating resin layer that covers the ferrite particles, the ferrite particles having a Brunauer-Emmitt-Teller (BET) specific surface area of from about 0.12 $m^2/g$ to about 0.20 $m^2/g$, and having a fluidity of from about 26 sec/50 g to about 30 sec/50 g.

BRIEF DESCRIPTION OF THE DRAWINGS

Exemplary embodiments of the present invention are described in detail based on the following figures, wherein.

Figure 1:
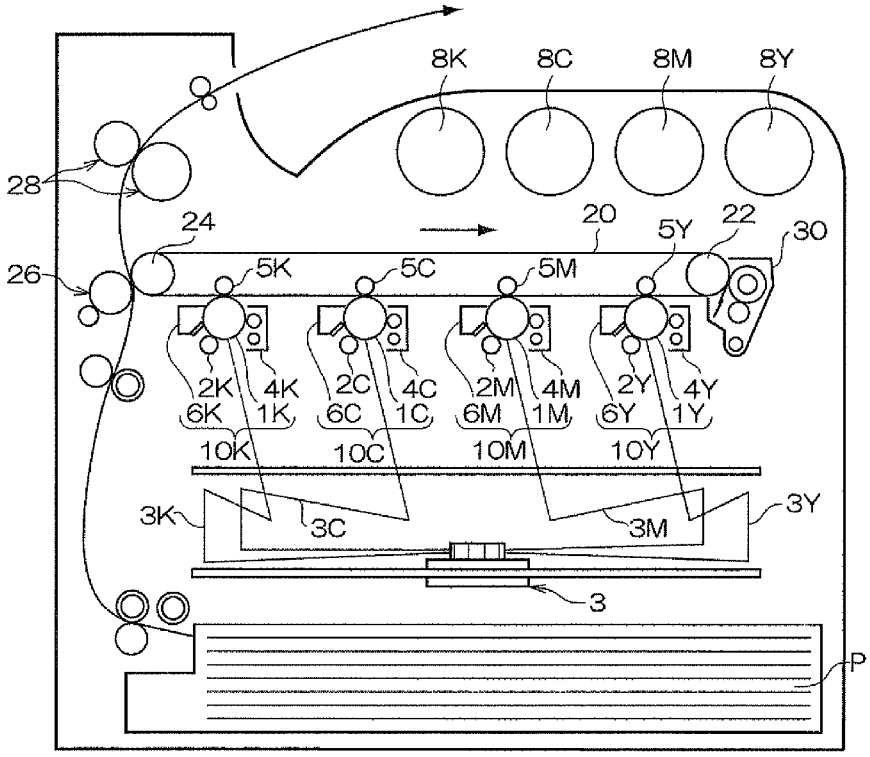
FIG. 1 is a schematic constitutional diagram which illustrates one example of an image forming apparatus of an exemplary embodiment of the present invention.

DETAILED DESCRIPTION (Carrier for Developing Electrostatic Charge Image)

A carrier for developing an electrostatic charge image according to an exemplary embodiment of the present invention (hereinafter, may be merely referred to as a "carrier") has a core material and a coating resin layer that covers the core material.

Ferrite particles having a Brunauer-Emmitt-Teller (BET) specific surface area of from 0.12 $m^2/g$ to 0.20 $m^2/g$ (or from about 0.12 $m^2/g$ to about 0.20 $m^2/g$), and having a fluidity of from 26 sec/50 g to 30 sec/50 g (or from about 26 sec/50 g to about 30 sec/50 g) are used as the core material.

By using the carrier of an exemplary embodiment of the present invention having such a configuration, an image in which the occurrence of fog is suppressed may be obtained, even in a case in which successive output of images is carried out under the condition in which the toner consumption is set low (for example, the toner consumption is set to be 0.4 $g/m^2$ or less), then the developer used is left under a high temperature and high humidity (for example, at 30° C. and 88% RH) environment, and then output of an image is carried out. The reason for this is not clear, but may be guessed as follows.

In general, for example, when successive output is carried out under the condition in which the toner consumption is set low such as output of characters or the like, the developer in the developing device is continued to be stirred excessively, so that there may be a case in which the toner is excessively charged. In this case, in the image forming apparatus, the condition is changed to that for the toner having an excessively increased charge amount to carry out image output.

On the other hand, since the developer in the developing device is continued to be stirred excessively, it is thought that the carrier may be deteriorated due to peeling of the coating resin layer, adhesion of the external additive of the toner, or the like, and as a result, the charge imparting ability to the toner may be deteriorated or the charge amount of the toner may easily be increased.

In the case in which the successive output of images is carried out and then the developer used is left under a high temperature and high humidity environment, as described above, the charge amount of the toner may easily be decreased, and in addition to the decrease in the charge amount of the toner, the charge imparting ability of the carrier may be also deteriorated. Therefore, the increase in the charge amount of toner may become slow. It is thought that, when image output is conducted under the condition set for the toner having an excessively increased charge amount, while the toner being in such a state, fog may occur.

Therefore, with regard to the carrier of an exemplary embodiment of the present invention, a ferrite particle having a BET specific surface area of from 0.12 $m^2/g$ to 0.20 $m^2/g$ (or from about 0.12 $m^2/g$ to about 0.20 $m^2/g$), and having a fluidity of from 26 sec/50 g to 30 sec/50 g (or from about 26 sec/50 g to about 30 sec/50 g) is used as the core material. The ferrite particle having such characteristics means a ferrite particle that has a tendency of having a high BET specific surface area and a high fluidity, specifically, a ferrite particle which has irregularities on the particle surface, in which convex portions (outstanding portions) in the irregularities are present uniformly on the particle surface.

It is thought that, when a coating resin is coated on the ferrite particle having such characteristics, the coating resin layer is less likely to be peeled off due to the anchor effect of the irregularities of the ferrite particle, and at the same time, the surface of the coating resin layer easily becomes smooth, since the convex portions (outstanding portions) of the ferrite particle are present uniformly.

As described above, in the carrier of an exemplary embodiment of the present invention, the surface of the coating resin layer is smooth. Therefore, it is thought that the stirring property of the developer is enhanced, as well as the movement of the external additive of the toner is less likely to occur, and as a result, even in a case in which successive output of images is carried out under the condition in which the toner consumption is set low such as output of characters or the like, the increase in the charge amount of the toner, namely, variation in the charge amount of the toner may be suppressed.

Further, since the surface of the coating resin layer is smooth in the carrier of an exemplary embodiment of the present invention, the area of a portion of the carrier that contacts with the toner is reduced. Therefore, it is thought that, even in a case in which the developer is left under a high temperature and high humidity environment, the decrease in the charge amount of the toner, namely, variation in the charge amount of the toner may be suppressed.

Moreover, since the surface of the coating resin layer is smooth in the carrier of an exemplary embodiment of the present invention, the stirring property of the developer is enhanced, as well as the deterioration in charge imparting ability is less likely to occur, since the peeling of the coating resin layer is less likely to occur. Therefore, it is thought that the increase in the charge amount of the toner is made faster by stirring the developer, and an intended charge amount may be imparted to the toner in a short time.

Specifically, it is thought that, by using the carrier of an exemplary embodiment of the present invention, the increase in charge amount of the toner is slight even in a case in which successive output of images is carried out under the condition in which the toner consumption is set low, such as output of characters, and the decrease in the charge amount of the toner is slight and the toner may be charged in a short time even in a case in which the developer is left under a high temperature and high humidity condition.

For the reasons described above, it is thought that, by using the carrier of an exemplary embodiment of the present invention, an image in which the occurrence of fog is suppressed may be obtained, even in a case in which successive output of images is carried out under the condition in which the toner consumption is set low, then the developer used is left under a high temperature and high humidity environment, and then output of an image is carried out.

Hereinafter, the carrier of an exemplary embodiment of the present invention is described in detail.

The carrier of an exemplary embodiment of the present invention has a core material and a coating resin layer that covers the core material.

First, the core material is described.

Ferrite particles are used as the core material. Examples of the ferrite particles include those including a ferrite having a structure represented by the following formula.

$$(MO)_X(Fe_2O_3)_Y \qquad \text{Formula}$$

In the above formula, M represents at least one selected from the group consisting of Mn, Li, Ca, Sr, Sn, Cu, Zn, Ba, Mg, and Ti (preferably, M represents at least one selected from the group consisting of Mn, Li, Ca, Sr, Mg, and Ti). X and Y each represent a mole ratio, and X and Y satisfy the relationship X+Y=100.

Among the ferrite particles including a ferrite having the structure represented by the above formula, examples of the ferrite particles in which M represents plural metals include known ferrite particles such as manganese-zinc ferrite particles, nickel-zinc ferrite particles, manganese-magnesium ferrite particles, and copper-zinc ferrite particles.

Note that, the materials that form the ferrite particles are not limited to the above materials, and the ferrite particles may include one or more components other than the above materials, if necessary.

The BET specific surface area of the ferrite particle is in a range of from 0.12 $m^2/g$ to 0.20 $m^2/g$ (or from about 0.12 $m^2/g$ to about 0.20 $m^2/g$), but is preferably in a range of from 0.14 $m^2/g$ to 0.18 $m^2/g$ (or from about 0.14 $m^2/g$ to about 0.18 $m^2/g$), and more preferably from 0.15 $m^2/g$ to 0.17 $m^2/g$ (or from about 0.15 $m^2/g$ to about 0.17 $m^2/g$).

It should be noted that the BET specific surface area is measured by a nitrogen substitution method using SA3100 SPECIFIC SURFACE AREA METER (trade name, manufactured by Beckmann Coulter) in accordance with the three-point method. Specifically, 5 g of a ferrite particle sample are placed in a cell, which is deaerated at 60° C. for 120 minutes, and then the measurement of the BET specific surface area is carried out using a mixed gas of nitrogen and helium (at a ratio of 30:70).

The fluidity of the ferrite particle is in a range of from 26 sec/50 g to 30 sec/50 g (or from about 26 sec/50 g to about 30 sec/50 g), but is preferably in a range of from 27 sec/50 g to 30 sec/50 g (or from about 27 sec/50 g to about 30 sec/50 g), and more preferably in a range of from 28 sec/50 g to 29 sec/50 g (or from about 28 sec/50 g to about 29 sec/50 g).

Note that, the fluidity is measured in accordance with a method prescribed in Measurement of Fluidity: JIS-Z2502 (2000), which is incorporated herein by reference.

The average particle diameter of the ferrite particles is preferably in a range of from 30 μm to 90 μm (or from about 30 μm to about 90 μm), and more preferably in a range of from 50 μm to 80 μm (or from about 50 μm to about 80 μm).

Note that, the average particle diameter is determined, for example, as follows. Namely, the particle diameters of 100 particles are measured from an SEM (scanning electron microscope) micrograph of the particles, and the particle diameter of the 50th smallest particle is defined as the average particle diameter.

The volume resistivity of the ferrite particles is preferably in a range of from $1.0\times10^5$ Ωcm to $1.0\times10^8$ Ωcm (or from about $1.0\times10^5$ Ωcm to about $1.0\times10^8$ Ωcm), under a high electric field (under an electric field of 15,000 V/cm), and more preferably in a range of from $1.0\times10^5$ Ωcm to $1.0\times10^{7.6}$ Ωcm (or from about $1.0\times10^5$ Ωcm to about $1.0\times10^{7.6}$ Ωcm).

The volume resistivity is measured by the following method. First, ferrite particles which serve as the object to be measured are placed flat, so that the thickness becomes from about 1 mm to about 3 mm, on a surface of a circular jig equipped with an electrode plate having an area of 20 $cm^2$, whereby forming a ferrite particle layer. Another electrode plate having an area of 20 $cm^2$ which is the same as the area of the above electrode plate is placed on the ferrite particle layer so as to sandwich the ferrite particle layer with the two electrode plates. In order to remove voids between the ferrite particles, a load of 4 kg is applied onto the electrode plate which is placed on the ferrite particle layer. Thereafter, the thickness (cm) of the ferrite particle layer is measured. The two electrodes, above and below the ferrite particle layer, are connected to an electrometer and a high-voltage power source generating device. A high voltage is applied to the two electrodes such that an electric field of 15,000 V/cm is provided, and by reading the current value (A) that flows at that voltage, the volume resistivity (Ω·cm) of the ferrite particles is calculated. The equation for calculating the volume resistivity (Ω·cm) of the ferrite particles is as shown below.

$$\rho = E\times20/(I-I_0)/L \qquad \text{Equation}$$

In the above equation, p represents the volume resistivity (Ω·cm) of the ferrite particles, E represents the applied voltage (V), I represents the current value (A), $I_0$ represents the current value (A) when the applied voltage is 0 V, and L represents the thickness (cm) of the ferrite particle layer. Further, the coefficient "20" represents the area ($cm^2$) of the electrode plate.

With regard to the magnetic force of the ferrite particles, the saturation magnetization in a magnetic field of 1,000 Oe is preferably 40 emu/g or more (or about 40 emu/g or more), and more preferably 50 emu/g or more (or about 50 emu/g or more).

In the measurement of magnetic characteristics, a vibrating sample magnetometer VSMP10-15 (trade name, manufactured by Toei Kogyo Co., Ltd.) is used as an apparatus for measurement. The measurement sample is placed in a cell having an inner diameter of 7 mm and a height of 5 mm, and then set in the above apparatus. In the measurement, a magnetic field is applied, and then the magnetic field is swept up to a maximum value of 1,000 Oe. Subsequently, the applied magnetic field is decreased to prepare a hysteresis curve on a recording paper. From the data in this hysteresis curve, saturation magnetization, residual magnetization, and coercive force are determined.

The ferrite particles may be subjected to a coupling treatment by using a coupling agent, in order to enhance the adherence between the ferrite particle surface and the coating resin layer. Examples of the coupling agent include a silane coupling agent, a silicone oil, a titanate coupling agent, and an aluminum coupling agent. One of these coupling agents may be used alone, or two or more of them may be used in combination. Among these coupling agents, a silane coupling agent is preferable.

The ferrite particles may be obtained, for example, by granulation and sintering. As a pretreatment to achieve granulation, an oxide of the raw material may be subjected to a fine grinding processing.

Here, the ferrite particles having the above characteristics (BET specific surface area and fluidity) have a narrow distribution range of size of fine particle boundary, and thus, are difficult to obtain in accordance with a conventional production method. The reason for this is as follows. In order to adjust the BET specific surface area to within the above range, the growth of particle boundary may be suppressed by adjusting the temperature for calcination and the concentration of oxygen. However, in order to adjust the fluidity to within the above range, the temperature for calcination should be higher and the growth of particle boundaries should be enhanced. Thus, these have tendencies conflicting with each other from the point of view of production.

For the above reason, it is preferable that the ferrite particles having the above characteristics (BET specific surface area and fluidity) are obtained by the following production method.

Specifically, first, impurities in the raw material (for example, chlorine or silicon) are eliminated as much as possible. In this process, for example, the amount of impurities in the raw material may be 100 ppm or less (or about 100 ppm or less) with respect to a total amount of the raw material.

Then, the raw material is subjected to grinding and mixing, but ferritization is not performed, and temporary calcination for oxidizing the raw material is carried out. In this process, the temperature for temporary calcination may be from 900° C. to 1,100° C. (or from about 900° C. to about 1,100° C.).

Then, the temporarily calcined substance thus obtained is subjected to grinding, and dispersed in water together with a binder (for example, PVA (polyvinyl alcohol) or the like) to obtain a slurry.

In this process, the grinding of the temporarily calcined substance may be carried out such that the average particle diameter of the ground substances becomes from 1.8 μm to 2.2 μm (or from about 1.8 μm to about 2.2 μm). Here, the average particle diameter of the ground substances is measured in the state of a slurry using a laser diffraction/scattering particle size distribution analyzer (trade name: LS PARTICLE SIZE ANALYZER LS13 320, manufactured by Beckman Coulter). In the measurement, the sample is dispersed in water, and the pump speed is set at 90%. From the obtained results of particle size distribution, the volume cumulative distribution is plotted from the smaller particle diameter side, in terms of the divided particle size ranges (channels), and the particle diameter of 50% accumulation is defined as the volume average particle diameter D50v, which is the average particle diameter of the ground substance.

Further, in the grinding of the temporarily calcined substances, it may add $SiO_2$ in an addition amount (addition amount with respect to the amount of solids in the slurry) of about 1%, for the purpose of inhibiting sintering of the calcined substance, and perform mixing and grinding.

It is thought that, when the particle size of the ground substance is within the above range and the addition amount of $SiO_2$ is as described above, the particle boundaries uniformly grow and do not grow too much, and thus, the intended BET specific surface area and fluidity may be obtained.

Subsequently, the resulting slurry is granulated and dried using a spray dryer or the like.

Then, regular calcination is performed while adjusting the temperature so as to obtain the intended BET specific surface area and fluidity.

Thereafter, the regularly calcined substances thus obtained are classified, whereby ferrite particles having the above characteristics (BET specific surface area and fluidity) are obtained.

Next, the coating resin layer is described.

The coating resin layer is a layer that covers the surface of the ferrite particle.

Examples of the resin that may be used in the coating resin layer include an acrylic resin, a polyethylene resin, a polypropylene resin, a polystyrene resin, a polyacrylonitrile resin, a polyvinyl acetate resin, a polyvinyl alcohol resin, a polyvinyl butyral resin, a polyvinyl chloride resin, a polyvinylcarbazole resin, a polyvinyl ether resin, a polyvinyl ketone resin, a vinyl chloride-vinyl acetate copolymer, a styrene-acrylic acid copolymer, a straight silicone resin having an organosiloxane bond or a modified product thereof, a fluororesin, a polyester resin, a polyurethane resin, a polycarbonate resin, a phenol resin, an amino resin, a melamine resin, a benzoguanamine resin, a urea resin, an amide resin, and an epoxy resin.

Among them, an acrylic resin having a cyclohexyl group is preferable as the resin that forms the coating resin layer.

It is thought that, due to the polarity of the cyclohexyl group, when an acrylic resin having a cyclohexyl group is contained in the coating resin layer, the increase in the charge amount of toner, namely, the variation in the charge amount may be suppressed, even in a case in which successive output of images is carried out under the condition in which the toner consumption is set low, such as output of characters or the like.

Further, it is thought that, due to the hydrophobicity of the cyclohexyl group, when an acrylic resin having a cyclohexyl group is contained in the coating resin layer, the increase in the charge amount of toner, namely, the variation in the charge amount may be suppressed, in a case in which the developer is left under a high temperature and high humidity environment.

Accordingly, when an acrylic resin having a cyclohexyl group is incorporated in the coating resin layer, an image in which the occurrence of fog is suppressed may easily be obtained, even in a case in which successive output of images is carried out under the condition in which the toner consumption is set low, then the developer used is left under a high temperature and high humidity environment, and then output of an image is carried out.

The acrylic resin having a cyclohexyl group may be includeed in the coating resin layer in an amount of about 80% by weight, with respect to the resin that forms the coating resin layer.

Specific examples of the acrylic resin having a cyclohexyl group include a homopolymer of an acryl monomer having a cyclohexyl group, and a copolymer obtained by copolymerization using an acryl monomer having a cyclohexyl group and one or more other monomers.

Examples of the acryl monomer having a cyclohexyl group include cyclohexyl acrylate and cyclohexyl methacrylate.

With respect to a monomer used for the copolymer, include styrene, acrylic acid, and acrylic acid esters such as methyl acrylate, methyl methacrylate, ethyl acrylate, and ethyl methacrylate.

The acrylic resin having a cyclohexyl group may contain polymerization components derived from the acryl monomer having a cyclohexyl group in an amount of 80% by weight or more (or about 80% by weight or more).

The weight average molecular weight of the resin included in the coating resin layer is preferably from 5,000 to 1,000,000 (or from about 5,000 to about 1,000,000), and more preferably from 10,000 to 200,000 (or from about 10,000 to about 200,000).

The coating resin layer is preferably coated at an amount of from 0.5 parts by weight to 10 parts by weight (or from about 0.5 parts by weight to about 10 parts by weight), and more preferably from 1 part by weight to 5 parts by weight (or from about 1 part by weight to about 5 parts by weight), with respect to 100 parts by weight of the ferrite particles.

The coating ratio of the coating resin layer on the ferrite particle surface is preferably 80% or higher (or about 80% or higher), and more preferably from 85% to 95% (or from about 85% to about 95%).

The coating ratio of the coating resin layer may be determined by XPS measurement (X-ray photoelectron spectroscopy measurement). As the XPS measurement apparatus, JPS80 (trade name) manufactured by JEOL Ltd. is used. In the measurement, an MgKα ray is used as the X-ray source, and the acceleration voltage and the emission current are set to 10 kV and 20 mV, respectively. Measurement is conducted with regard to the element that is a main component of the coating resin layer (usually, carbon) and the elements that are main components of the ferrite particles (for example, iron and oxygen). Herein, a C1s spectrum is measured for carbon, an Fe2p3/2 spectrum is measured for iron, and an O1s spectrum is measured for oxygen.

Based on the spectrum of each of the elements, the number of carbon, oxygen, and iron elements ($A_C+A_O+A_{Fe}$) is determined. From the obtained number ratio of carbon, oxygen, and iron elements, the iron amount ratio of the ferrite particle alone and the iron amount ratio after the ferrite particle is covered with the coating resin layer (iron amount ratio of the carrier) are determined based on the following equation. Then, the coating ratio is determined according to the following equation.

$$\text{Iron Amount Ratio (atomic \%)}=A_{Fe}/(A_C+A_O+A_{Fe})\times 100 \quad \text{Equation}$$

$$\text{Coating Ratio (\%)}=\{1-(\text{Iron Amount Ratio of Carrier})/(\text{Iron Amount Ratio of Ferrite Particle Alone})\}\times 100$$

The average film thickness of the coating resin layer is preferably from 0.1 μm to 10 μm (or from about 0.1 μm to about 10 μm), and more preferably from 0.1 μm to 3.0 μm (or from about 0.1 μm to about 3.0 μm).

The average film thickness (μm) of the coating resin layer is determined according to the following equation. In the following equation, ρ (dimensionless) represents the true specific gravity of the ferrite particles, d (μm) represents the volume average particle diameter of the ferrite particles, $\rho_C$ represents the average specific gravity of the coating resin layer, and $W_C$ (parts by weight) represents the total content of the coating resin layer with respect to 100 parts by weight of the ferrite particles.

$$\text{Average Film Thickness (μm)}=[\text{Amount of Coating Resin per One Carrier (including all of the additives such as electrically conductive powder)}/\text{Surface Area per One Carrier}]\div\text{Average Specific Gravity of Coating Resin Layer}=[4/3\pi\cdot(d/2)^3\cdot\rho\cdot W_C]/[4\pi\cdot(d/2)^2]\div\rho_C=(1/6)\cdot(d\cdot\rho\cdot W_C/\rho_C) \quad \text{Equation}$$

The coating resin layer may contain electrically conductive particles. Examples of the electrically conductive materials used in electrically conductive particles include carbon, black; metals such as gold, silver, and copper; titanium oxide; zinc oxide; barium sulfate, aluminum borate; potassium titanate; and tin oxide.

The content of the electrically conductive particles is preferably from 1% by weight to 50% by weight (or from about 1% by weight to about 50% by weight), and more preferably from 3% by weight to 20% by weight (or from about 3% by weight to about 20% by weight).

An example of a method of coating the coating resin layer on the ferrite particle surface is a method of coating with a solution for forming a coating resin layer, which is prepared by, for example, dissolving the above coating resin and, as necessary, various additives in a proper solvent. The solvent is not particularly limited and may be selected in consideration of the coating resin to be used, coating suitability, and the like.

Specific examples of the method of coating the coating resin layer on the ferrite particle surface include a dipping method in which the ferrite particle to become a carrier is dipped in the solution for forming the coating resin layer; a spray method in which the solution for forming the coating resin layer is sprayed onto the surface the ferrite particle to become a carrier; a fluidized bed method in which the solution for forming the coating resin layer is sprayed onto the ferrite particle to become a carrier, which is made to float with a fluidizing air; and a kneader coater method in which the ferrite particle to become a carrier and the solution for forming the coating resin layer are mixed in a kneader coater, followed by removing the solvent.

(Developer for Developing Electrostatic Charge Image)

A developer for developing an electrostatic charge image according to an exemplary embodiment of the present invention (hereinafter, may be referred to as a "developer") contains a toner for developing an electrostatic charge image (hereinafter, referred to as a "toner") and the carrier of an exemplary embodiment of the present invention.

The mixing ratio (ratio by weight) of the toner to the carrier (toner:carrier) is preferably in a range of from 1:100 to 30:100 (or from about 1:100 to about 30:100), and more preferably in a range of from 3:100 to 20:100 (or from about 3:100 to about 20:100).

Hereinafter, the toner is described.

The toner includes, for example, toner particles and an external additive.

The toner particle is not particularly limited. For example, the toner particles include a binder resin, a colorant and, as necessary, a release agent and one or more other components.

The binder resin is not particularly limited, and examples thereof include known materials such as polystyrene, a styrene-alkyl acrylate copolymer, a styrene-alkyl methacrylate copolymer, a styrene-acrylonitrile copolymer, a styrene-butadiene copolymer, a styrene-maleic anhydride copolymer, polyethylene, polypropylene, polyester, polyurethane, an epoxy resin, a silicone resin, polyamide, a modified rosin, and paraffin wax. Among them, a styrene-acryl copolymer and polyester are preferable.

The number average molecular weight (Mn) of the binder resin is preferably from 2,500 to 20,000 (or from about 2,500 to about 20,000), and more preferably from 4,000 to 15,000 (or from about 4,000 to about 15,000).

The weight average molecular weight (Mw) of the binder resin is preferably from 9,000 to 90,000 (or from about 9,000 to about 90,000), and more preferably from 12,000 to 60,000 (or from about 12,000 to about 60,000).

The softening temperature (Tm) of the binder resin is preferably from 60° C. to 120° C. (or from about 60° C. to about 120° C.), and more preferably from 80° C. to 100° C. (or from about 80° C. to about 100° C.).

The glass transition temperature (Tg) of the binder resin is preferably from 45° C. to 70° C. (or from about 45° C. to about 70° C.), and more preferably from 50° C. to 60° C. (or from about 50° C. to about 60° C.).

Here, the molecular weight (Mn or Mw) of the binder resin is measured using GPC: HLC8120GPC (trade name) manufactured by Tosoh Corporation. Further, the softening temperature (Tm) is measured using FLOW TESTER: CFT500C (trade name) manufactured by Shimadzu Corporation. The glass transition temperature (Tg) is measured using DSC: DSC60 (trade name) manufactured by Shimadzu Corporation.

Examples of the colorant include known organic or inorganic pigments and dyes, and oil-soluble dyes.

Examples of a black pigment include carbon black and magnetic powder.

Examples of a yellow pigment include Hanza Yellow, Hanza Yellow 10G, Benzidine Yellow G, Benzidine Yellow GR, threne yellow, quinoline yellow, and Permanent Yellow NCG.

Examples of a red pigment include red iron oxide, Watchung Red, Permanent Red 4R, Lithol Red, Brilliant Carmine 3B, Brilliant Carmine 6B, Du Pont oil red, pyrazolone red, Rohdamine B Lake, Lake Red C, rose bengal, eoxine red, and alizarin lake.

Example of a blue pigment include iron blue, cobalt blue, alkali blue lake, Victoria Blue Lake, Fast Sky Blue, Indanthrene Blue BC, aniline blue, ultramarine blue, Calco Oil Blue, methylene blue chloride, phthalocyanine blue, phthalocyanine green, and malachite green oxalate.

These colorants may be mixed and used. The colorants may be used in the state of a solid solution.

The content of the colorant is preferably in a range of from 2% by weight to 15% by weight or (from about 2% by weight to about 15% by weight), and more preferably in a range of from 3% by weight to 10% by weight (or from about 3% by weight to about 10% by weight), with respect to the components that constitute the toner particle.

The release agent is not particularly limited, and examples thereof include petroleum wax, mineral wax; animal and vegetable wax; and synthetic waxes such as polyolefin wax, oxidized polyolefin wax, and Fischer Tropsch wax. The melting point of the release agent is preferably from 40° C. to 150° C. (or from about 40° C. to about 150° C.), and more preferably from 50° C. to 120° C. (or from about 50° C. to about 120° C.).

The content of the release agent is preferably in a range of from 1% by weight to 10% by weight (or from about 1% by weight to about 10% by weight), and more preferably in a range of from 2% by weight to 8% by weight (or from about 2% by weight to about 8% by weight), with respect to the components that constitute the toner particle with respect to a total content of components of the toner.

Examples of the one or more other components include various components such as an internal additive, a charge controlling agent, and inorganic powder (inorganic particles).

Examples of the internal additive include magnetic substances such as metals, for example, ferrite, magnetite, reduced iron, cobalt, nickel, manganese, or the like, alloys, and compounds including the metal.

Examples of the charge controlling agent include compounds selected from the group consisting of metal salts of benzoic acid, metal salts of salicylic acid, metal salts of alkylsalicylic acid, metal salts of catechol, metal-containing bisazo dyes, tetraphenyl borate derivatives, quaternary ammonium salts, and alkylpyridinium salts; and resin type charge controlling agents containing a polar group.

Examples of the inorganic particles include known inorganic particles such as silica particles, titanium oxide particles, alumina particles, cerium oxide particles, and particles obtained by subjecting the surfaces of these particles to a hydrophobizing treatment. These inorganic particles may be subjected to various surface treatments. For example, inorganic particles which have been subjected to a surface treatment by using a silane coupling agent, a titanium compound coupling agent, a silicone oil, or the like are preferable.

The volume average particle diameter of the toner particles may be, for example, from 4 μm to 15 μm (or from about 4 μm to about 15 μm), and preferably from 5 μm to 10 μm (or from about 5 μm to about 10 μm).

Note that, the volume average particle diameter of the toner particles is measured according to the following measurement method. To 2 mL of a 5% by weight aqueous solution of a surfactant as a dispersant, preferably, sodium alkylbenzenesulfonate, a measurement sample in an amount of from 0.5 mg to 50 mg is added. The resulting liquid is added to 100 mL to 150 mL of a electrolytic liquid. The resulting electrolyte liquid in which the measurement sample is suspended is subjected to a dispersion treatment for about 1 minute using an ultrasonic disperser. Then, using a COULTER MULTISIZER II (trade name, manufactured by Beckman Coulter), and using an aperture having an aperture diameter of 100 μm, the particle distribution of particles having particle diameters in a range of from 2.0 μm to 60 μm is measured. The number of particles used for the measurement is 50,000.

From the obtained results of particle size distribution, the volume cumulative distribution is plotted from the smaller particle diameter side, in terms of the divided particle size ranges (channels), and the particle diameter of 50% accumulation is defined as the volume average particle diameter D50v.

Next, the external additive is described.

Examples of the external additive include inorganic particles. Examples of materials of the inorganic particles include $SiO_2$, $TiO_2$, $Al_2O_3$, CuO, ZnO, $SnO_2$, $CeO_2$, $Fe_2O_3$, MgO, BaO, CaO, $K_2O$, $Na_2O$, $ZrO_2$, $CaO.SiO_2$, $K_2O.(TiO_2)_n$, $Al_2O_3.2SiO_2$, $CaCO_3$, $MgCO_3$, $BaSO_4$, and $MgSO_4$.

The surface of the external additive may be subjected to a hydrophobizing treatment in advance. The hydrophobizing treatment may be carried out, for example, by dipping the inorganic particles in a hydrophobizing agent, or the like. The hydrophobizing agent is not particularly limited, and examples thereof include a silane coupling agent, a silicone oil, a titanate coupling agent, and an aluminum coupling agent. One of these hydrophobizing agents may be used alone, or two or more of them may be used in combination.

The amount of the hydrophobizing agent is usually from 1 part by weight to 10 parts by weight (or from about 1 part by weight to about 10 parts by weight), with respect to 100 parts by weight of the inorganic particles.

The external addition amount of the external additive may be from 0.5 parts by weight to 2.5 parts by weight (or from about 0.5 parts by weight to about 2.5 parts by weight), with respect to 100 parts by weight of the toner particles.

Next, a method for producing the toner according to an exemplary embodiment of the present invention is described.

The toner particles may be produced by any of a dry production method (for example, a kneading and grinding method or the like) and a wet production method (for example, an aggregation coalescence method, a suspension polymerization method, a dissolution suspension granulation method, a dissolution suspension method, a dissolution emulsification aggregation coalescence method, or the like). These production methods are not particularly limited, and a known production method may be adopted.

The toner may be produced by adding an external additive to the obtained toner particles, followed by mixing them. Mixing may be carried out using, for example, a V blender, a HENSCHEL MIXER, a LOEDIGE MIXER, or the like. Further, as needs arise, coarse toner particles may be removed by using a vibratory sieving machine, a pneumatic sieving machine, or the like.

(Image Forming Apparatus and the Like)

Next, an image forming apparatus of an exemplary embodiment of the present invention is described.

An image forming apparatus of an exemplary embodiment of the present invention has an image holding body; a charging unit that charges the image holding body; an electrostatic charge image forming unit that forms an electrostatic charge image on a surface of the charged image holding body; a developing unit that stores a developer for developing an electrostatic charge image and develops the electrostatic charge image formed on the image holding body to provide a toner image using the developer for developing an electrostatic charge image; a transferring unit that transfers the toner image formed on the image holding body onto a transfer medium; and a fixing unit that fixes the toner image transferred onto the transfer medium. Further, in the image forming apparatus, the developer for developing an electrostatic charge image according to an exemplary embodiment of the present invention is used as the developer for developing an electrostatic charge image.

It should be noted that, in the image forming apparatus of an exemplary embodiment of the present invention, for example, the portion including the developing unit may have a cartridge structure (may be a process cartridge, a developer cartridge and so on) which is attachable to or detachable from the image forming apparatus. As the process cartridge, for example, a process cartridge that stores the developer for developing an electrostatic charge image according to an exemplary embodiment of the present invention and is provided with a developing unit may be used.

Hereinafter, the image forming apparatus of an exemplary embodiment of the present invention is described with reference to one example, but the invention is not limited to the example. In the following description, principle parts shown in the drawing are explained, and explanation of other parts is omitted.

FIG. 1 is a schematic constitutional diagram showing a color image forming apparatus of a four-series tandem system. The image forming apparatus shown in FIG. 1 is equipped with first to fourth image forming units 10Y, 10M, 10C, and 10K (image forming portion) of an electrophotography system, each of which outputs an image of respective color of yellow (Y), magenta (M), cyan (C), and black (K), based on color-separated image data. These image forming units (hereinafter, may be merely referred to as "units" in some cases) 10Y, 10M, 10C, and 10K are disposed in parallel in the horizontal direction at a predetermined distance from each other. It should be noted that the units 10Y, 10M, 10C, and 10K may be a process cartridge which is attachable to or detachable from the body of the image forming apparatus.

At the upper side in the drawing of the units 10Y, 10M, 10C, and 10K, an intermediate transfer belt 20 as an intermediate transfer body is provided so that the belt runs through all the four units. The intermediate transfer belt 20 is wound around a driving roller 22 and a support roller 24 which is in contact with the inner surface of the immediate transfer belt 20, in which the driving roller 22 and the support roller 24 are arranged to be apart from each other from the left to right direction in the drawing. The intermediate transfer belt 20 runs in the direction of from the first unit 10Y toward the fourth unit 10K. Note that, the support roller 24 is pressed in the direction departing from the driving roller 22 by a spring or the like (not shown), and a tension is applied to the intermediate transfer belt 20 wound around the two rollers. Further, on the image holding body side of the intermediate transfer belt 20, an intermediate transfer body cleaning unit 30 is disposed to oppose the driving roller 22.

Furthermore, developers containing toners of four colors of yellow, magenta, cyan, and black, respectively, are stored in developer cartridges 8Y, 8M, 8C, and 8K, and the developers can be supplied to developing devices (developing units) 4Y, 4M, 4C, and 4K of the respective units 10Y, 10M, 10C, and 10K.

The first to fourth units 10Y, 10M, 10C, and 10K described above have configurations equivalent to each other. Accordingly, the first unit 10Y that forms a yellow image, which is arranged at the upstream side with regard to the moving direction of the intermediate transfer belt, is described here as a representative thereof. Note that, to portions that correspond to the portions in the first unit 10Y, reference symbols with magenta (M), cyan (C), or black (K) are imparted in place of yellow (Y), and descriptions of the second to fourth units 10M, 10C, and 10K are omitted. (1M, 1C, and 1K each represent a photoreceptor of the respective unit; 2M, 2C, and 2K each represent a charging roller of the respective unit; and 6M, 6C, and 6K each represent a photoreceptor cleaning device of the respective unit. 3M, 3C, and 3K each represent a laser beam.)

The first unit 10Y has a photoreceptor 1Y that acts as an image holding body. Around the photoreceptor 1Y, a charging roller 2Y that charges the surface of the photoreceptor 1Y at a predetermined electric potential; a light exposing device (electrostatic charge image forming unit) 3 that exposes the charged surface by a laser beam 3Y based on color-separated image signals to form an electrostatic charge image; a developing device (developing unit) 4Y that supplies a charged toner to the electrostatic charge image and develops the electrostatic charge image; a primary transfer roller (primary transferring unit) 5Y that transfers the developed toner image onto the intermediate transfer belt 20; and a photoreceptor cleaning device (cleaning unit) 6Y that removes a toner remaining on the surface of the photoreceptor 1Y after the primary transfer are disposed in this order. Note that, the primary transfer roller 5Y is disposed at the inner side of the intermediate transfer belt 20 and is provided at a position opposite to the photoreceptor 1Y. Further, bias power sources (not shown) that apply a primary transfer bias are each connected to the respective primary transfer rollers 5Y, 5M, 5C, and 5K. Each bias power source can change the transfer bias to be applied to the corresponding primary transfer roller by a control portion (not shown).

Hereinafter, an operation of forming a yellow image in the first unit 10Y is described. First, before the operation, the surface of the photoreceptor 1Y is charged by the charging roller 2Y to have an electric potential of from about −600 V to about −800 V.

The photoreceptor 1Y is formed by disposing a photosensitive layer on an electrically conductive substrate (volume resistivity at 20° C.: $1\times10^{-6}$ Ωcm or less). This photosensitive layer usually has high resistance (comparable to the resistance of a general resin) however, has a nature of changing the specific resistance of the portion irradiated with a laser beam, when irradiated with the laser beam 3Y. The laser beam 3Y is outputted through the light exposing device 3 onto the charged surface of the photoreceptor 1Y in accordance with image data for yellow transmitted from the control portion (not shown). The photosensitive layer on the surface of the photoreceptor 1Y is irradiated with the laser beam 3Y, whereby an electrostatic charge image in a yellow print pattern is formed on the surface of the photoreceptor 1Y.

The electrostatic charge image is an image formed on the surface of the photoreceptor 1Y by charging, and is a negative latent image formed by the following mariner. Namely, by the laser beam 3Y, the specific resistance of the irradiated portion of the photosensitive layer is lowered to allow electric charges charged on the surface of the photoreceptor 1Y to flow, while the electric charges of the portion which is not irradiated with the laser beam 3Y remain, thereby forming a negative image.

The electrostatic charge image thus formed on the photoreceptor 1Y is rotated to a predetermined developing position, accompanying movement of the photoreceptor 1Y. Then, at the developing position, the electrostatic charge image on the photoreceptor 1Y is visualized (developed) by the developing device 4Y.

In the developing device 4Y, for example, a developer for developing an electrostatic charge image according to an exemplary embodiment of the present invention, which contains at least a yellow toner and a carrier, is stored. The yellow toner is stirred inside the developing device 4Y to be frictionally charged, so that the yellow toner has an electric charge of the same polarity (negative polarity) as that of the electric charge charged on the photoreceptor 1Y, and the yellow toner is held on a developer roll (developer holding body). When the surface of the photoreceptor 1Y passes through the developing device 4Y, the yellow toner is electrostatically adhered to an electrically neutralized latent image area on the surface of the photoreceptor 1Y, and thus the latent image is developed by the yellow toner. The photoreceptor 1Y, on which the yellow toner image is formed, is subsequently moved at a predetermined speed and thus, the developed toner image on the photoreceptor 1Y is conveyed to the predetermined primary transfer position.

When the yellow toner image on the photoreceptor 1Y is conveyed to the primary transfer position, a primary transfer bias is applied to the primary transfer roller 5Y, and an electrostatic force directing from the photoreceptor 1Y toward the primary transfer roller 5Y acts on the toner image, and thus, the toner image on the photoreceptor 1Y is transferred onto the intermediate transfer belt 20. In this process, the transfer bias to be applied has a (+) polarity opposite to the polarity (−) of the toner. For example, the transfer bias is controlled to about +10 μA by the control portion (not shown) in the first unit 10Y.

On the other hand, the toner remaining on the photoreceptor 1Y is removed and recovered in the cleaning device 6Y.

Further, the primary transfer biases to be applied to the primary transfer rollers 5M, 5C, and 5K located on the downstream side of the second unit 10M are also controlled in the same manner as in the first unit 10Y.

In this way, the intermediate transfer belt 20 onto which the yellow toner image has been transferred in the first unit 10Y is conveyed in order through the second to fourth units 10M, 10C and 10K, and toner images of the respective colors are transferred and superposed to achieve multiple transfer.

The intermediate transfer belt 20 on which the toner images of four colors have been multiple-transferred through the first to fourth units reaches a secondary transfer portion which is configured to include the intermediate transfer belt 20, the support roller 24 that is in contact with the inner surface of the intermediate transfer belt, and a secondary transfer roller (secondary transferring unit) 26 arranged at the side of an image holding surface of the intermediate transfer belt 20. On the other hand, a recording paper (transfer medium) P is supplied through a supplying mechanism with a predetermined timing to a gap between the secondary transfer roller 26 and the intermediate transfer belt 20 which are contacted with each other with pressure, and a secondary transfer bias is applied to the support roller 24. In this process, the transfer bias to be applied has a (−) polarity the same as the polarity (−) of the toner, and an electrostatic force directing from the intermediate transfer belt 20 toward the recording paper P acts on the toner image, and thus, the toner image on the intermediate transfer belt 20 is transferred onto the recording paper P. Note that, the secondary transfer bias in this process is determined depending on the resistance detected by a resistance detecting unit (not shown) that detects the resistance of the secondary transfer portion. The secondary transfer bias is controlled by voltage.

Thereafter, the recording paper P is sent to a pressurizing and contacting portion (nip portion) of a pair of fixing rolls in a fixing device (roll formed fixing unit) 28, and the toner image is heated, and thereby, the toner image of layered colors are fused and fixed on the recording paper P.

Examples of the transfer medium on which the toner image is to be transferred include plain paper used for copying machines of an electrophotography system, printers, or the like, and OHP (overhead projector) sheets.

In order to further improve smoothness of an image surface after fixation, it is preferred that the surface of the transfer medium is as smooth as possible. For example, a coated paper which is obtained by coating a surface of plain paper with a resin or the like, an art paper used for printing, or the like may be used.

After completion of the fixation of the color image, the recording paper P is conveyed toward a discharging portion, and thereby, a series of color image formation operations is finished.

In the image forming apparatus exemplified above, the toner image is transferred onto the recording paper P through the intermediate transfer belt 20. However, the present invention is not limited to this configuration. An image forming apparatus of an exemplary embodiment of the present invention may have a structure in which a toner image is directly transferred from a photoreceptor onto a recording paper.

(Process Cartridge and Developer Cartridge)

Figure 2:
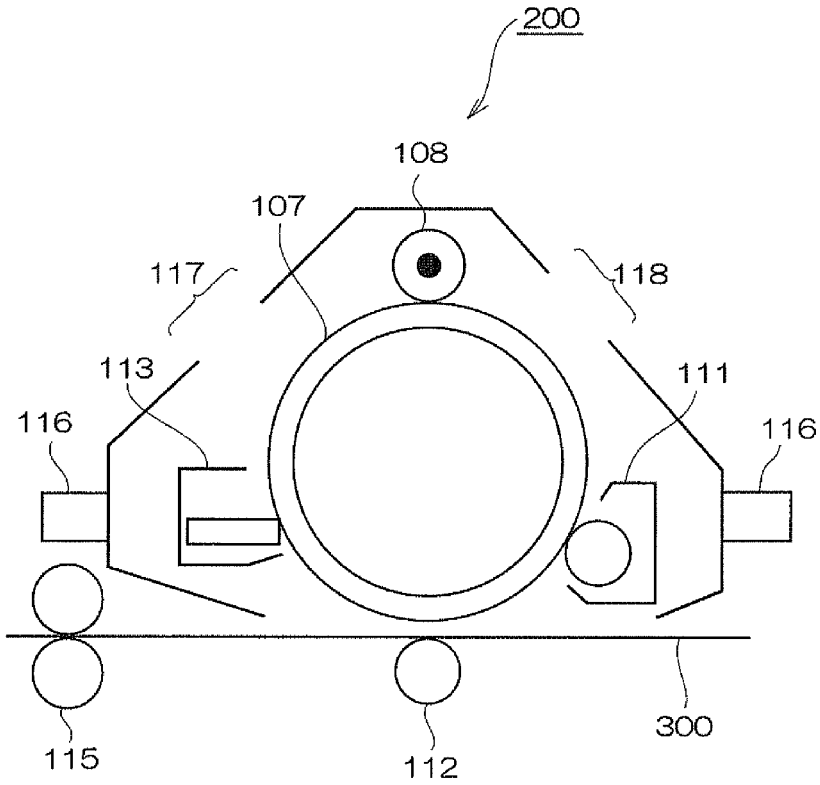
FIG. 2 is a schematic constitutional diagram which illustrates one example of a process cartridge of an exemplary embodiment of the present invention.

FIG. 2 is a schematic constitutional diagram which illustrates one preferable exemplary embodiment of a process cartridge that stores a developer for developing an electrostatic charge image according to an exemplary embodiment of the present invention. A process cartridge 200 includes a photoreceptor 107, as well as a charging roller 108, a developing device 111, a photoreceptor cleaning device 113, an opening 118 for exposure, and an opening 117 for electricity erasing and exposure, which are combined by using a fixing rail 116 and are integrated. In FIG. 2, the symbol 300 indicates a transfer medium.

The process cartridge 200 is configured to be attachable to and detachable from an image forming apparatus including a transfer device 112, a fixing device 115, and other constituent portions (not shown).

The process cartridge 200 shown in FIG. 2 is equipped with a charging device 108, a developing device 111, a cleaning device 113, an opening 118 for exposure, and an opening 117 for erasing of electricity and exposure, and these devices can be selectively used in combination. The process cartridge of an exemplary embodiment of the present invention includes, in addition to the photoreceptor 107, at least one selected from the group consisting of a charging device 108, a developing device 111, a cleaning device (cleaning unit) 113, an opening 118 for exposure, and an opening 117 for electricity erasing and exposure.

Next, a developer cartridge of an exemplary embodiment of the present invention is described. The developer cartridge of an exemplary embodiment of the present invention is attachable to and detachable from an image forming apparatus, and is a developer cartridge that stores at least a replenish developer for developing an electrostatic charge image, which is supplied to a developing unit provided in the image forming apparatus.

Note that, the image forming apparatus shown in FIG. 1 is an image forming apparatus having a configuration in which the developer cartridges 8Y, 8M, 8C, and 8K are attachable to and detachable from the body of the image forming apparatus. The developing devices 4Y, 4M, 4C, and 4K are each connected to the developer cartridge corresponding to the respective developing device (color) through a toner supply pipe (not shown). Further, in a case in which the amount of the toner stored inside the developer cartridge gets small, the developer cartridge is exchanged with a new one.

EXAMPLES

Hereinafter, an exemplary embodiment of the present invention will be described in detail with reference to Examples, but it should be construed that the exemplary embodiment of the present invention is in no way limited to these Examples. Note that, in the following description, the terms "part(s)" and "%" respectively refer to as "part(s) by weight" and "% by weight", unless otherwise noted.

[Preparation of Carrier]

(Preparation of Ferrite Particles)

—Preparation of Ferrite Particles 1—

1,318 parts by weight of $Fe_2O_3$ (extra pure reagent), 586 parts by weight of $Mn(OH)_2$ (extra pure reagent), and 96 parts by weight of $Mg(OH)_2$ (extra pure reagent) are mixed, and the mixture is subjected to mixing/grinding for 6 hours using a wet ball mill.

Then, the resulting mixture is granulated and dried using a spray dryer, and then subjected to temporary calcination at 900° C. for 7 hours using a rotary kiln.

To the temporarily calcined substance thus obtained, 15 g of $SiO_2$ (extra pure reagent) are added, and an aqueous solution of PVA is added so that the amount of PVA with respect to the amount of solids becomes 0.5% by weight. Thereafter, the mixture is ground using a wet ball mill until the average particle diameter reaches 1.8 μm.

Further, the resulting mixture is granulated and dried using a spray dryer, and then subjected to regular calcination for 6 hours in an electric oven under the conditions of temperature of 1,200° C. and oxygen concentration of 5% by volume.

The product is subjected to a crushing process and a classifying process to prepare ferrite particles 1 having an average particle diameter of 36 μm. The BET specific surface area and the fluidity (flow rate) of the obtained ferrite particles 1 are 0.16 $m^2/g$ and 28 sec/50 g, respectively.

—Preparation of Ferrite Particles 2—

In the preparation of the ferrite particles 1, the temperature for temporary calcination is changed to 890° C., $SiO_2$ is not added to the temporarily calcined substance, the addition amount of PVA is changed to give 1.0% by weight, and the grinding operation is performed until the average particle diameter of the ground substance reaches 2.0 μm. The succeeding regular calcination is carried out in a manner substantially similar to that in the preparation of the ferrite particles 1, except that the temperature for regular calcination is changed to 1,220° C. and the oxygen concentration is changed to 4.8% by volume. Thereby, ferrite particles 2 having an average particle diameter of 36 μm are prepared.

The BET specific surface area and the fluidity (flow rate) of the obtained ferrite particles 2 are 0.12 $m^2/g$ and 28 sec/50 g, respectively.

—Preparation of Ferrite Particles 3—

In the preparation of the ferrite particles 1, the amount of $SiO_2$ added to the temporarily calcined substance is changed to 25 g, and the grinding operation is performed until the average particle diameter of the ground substance reaches 2.0 p.m. The succeeding regular calcination is carried out in a manner substantially similar to that in the preparation of the ferrite particles 1, except that the temperature for regular calcination is changed to 1,180° C. Thereby, ferrite particles 3 having an average particle diameter of 36 μm are prepared.

The BET specific surface area and the fluidity (flow rate) of the obtained ferrite particles 3 are 0.20 $m^2/g$ and 28 sec/50 g, respectively.

—Preparation of Ferrite Particles 4—

In the preparation of the ferrite particles 1, the temperature for temporary calcination is changed to 910° C., the amount of $SiO_2$ added to the temporarily calcined substance is changed to 27 g, and the grinding operation is performed until the average particle diameter of the ground substance reaches 1.6 μm. The succeeding regular calcination is carried out in a manner substantially similar to that in the preparation of the ferrite particles 1, except that the temperature for regular calcination is changed to 1,220° C. Thereby, ferrite particles 4 having an average particle diameter of 36 μm are prepared.

The BET specific surface area and the fluidity (flow rate) of the obtained ferrite particles 4 are 0.16 $m^2/g$ and 26 sec/50 g, respectively.

—Preparation of Ferrite Particles 5—

In the preparation of the ferrite particles 1, the amount of $SiO_2$ added to the temporarily calcined substance is changed to 30 g, and the grinding operation is performed until the average particle diameter of the ground substance reaches 2.0 μm. The succeeding regular calcination is carried out in a manner substantially similar to that in the preparation of the ferrite particles 1. Thereby, ferrite particles 5 having an average particle diameter of 36 μm are prepared. The BET specific surface area and the fluidity (flow rate) of the obtained ferrite particles 5 are 0.16 $m^2/g$ and 30 sec/50 g, respectively.

—Preparation of Ferrite Particles 6—

In the preparation of the ferrite particles 1, the temperature for temporary calcination is changed to 880° C., $SiO_2$ is not added to the temporarily calcined substance, the addition amount of PVA is changed to give 2.0% by weight, and the grinding operation is performed until the average particle diameter of the ground substance reaches 1.8 μm. The succeeding regular calcination is carried out in a manner substantially similar to that in the preparation of the ferrite particles 1, except that the temperature for regular calcination is changed to 1,240° C. and the oxygen concentration is changed to 4.6% by volume. Thereby, ferrite particles 6 having an average particle diameter of 36 μm are prepared. The BET specific surface area and the fluidity (flow rate) of the obtained ferrite particles 6 are 0.08 $m^2/g$ and 26 sec/50 g, respectively.

—Preparation of Ferrite Particles 7—

In the preparation of the ferrite particles 1, the temperature for temporary calcination is changed to 920° C., the amount of $SiO_2$ added to the temporarily calcined substance is changed to 25 g, and the grinding operation is performed until the average particle diameter of the ground substance reaches 2.2 μm. The succeeding regular calcination is carried out in a manner substantially similar to that in the preparation of the ferrite particles 1, except that the temperature for regular calcination is changed to 1,195° C. and the oxygen concentration is changed to 5.2% by volume. Thereby, ferrite particles 7 having an average particle diameter of 36 μm are prepared. The BET specific surface area and the fluidity (flow rate) of the obtained ferrite particles 7 are 0.25 $m^2/g$ and 30 sec/50 g, respectively.

—Preparation of Ferrite Particles 8—

In the preparation of the ferrite particles 1, the amount of $SiO_2$ added to the temporarily calcined substance is changed to 20 g, and the time for grinding is changed to 4 hours. The grinding operation is performed until the average particle diameter of the ground substance reaches 2.5 μm. The succeeding regular calcination is carried out in a manner substantially similar to that in the preparation of the ferrite particles 1. Thereby, ferrite particles 8 having an average particle diameter of 36 μm are prepared. The BET specific surface area and the fluidity (flow rate) of the obtained ferrite particles 8 are 0.16 $m^2/g$ and 32 sec/50 g, respectively.

—Preparation of Ferrite Particles 9—

In the preparation of the ferrite particles 1, the temperature for temporary calcination is changed to 890° C., $SiO_2$ is not added to the temporarily calcined substance, the addition amount of PVA is changed to give 2.0% by weight, and the grinding operation is performed until the average particle diameter of the ground substance reaches 2.0 μm. The succeeding regular calcination is carried out in a manner substantially similar to that in the preparation of the ferrite particles 1, except that the temperature for regular calcination is changed to 1,220° C. Thereby, ferrite particles 9 having an average particle diameter of 36 μm are prepared. The BET specific surface area and the fluidity (flow rate) of the obtained ferrite particles 9 are 0.12 $m^2/g$ and 24 sec/50 g, respectively.

(Preparation of Coating Liquid: Solution for Forming Coating Resin Layer)

—Preparation of Coating Liquid 1—

| | |
|---|---|
| Cyclohexyl acrylate (weight average molecular weight of 50,000): | 36 parts by weight |
| Carbon black VXC72 (trade name, manufactured by Cabot Corporation): | 4 parts by weight |
| Toluene: | 250 parts by weight |
| Isopropyl alcohol: | 50 parts by weight |

The above components and glass beads (particle diameter: 1 mm, the same amount as the amount of toluene) are placed in a sand mill manufactured by Kansai Paint Co., Ltd., and stirred at a rotational speed of 1,200 rpm for 30 minutes, to prepare coating liquid 1 having a solid content of 11%.

—Preparation of Coating Liquid 2—

| | |
|---|---|
| Styrene-methyl methacrylate (polymerization ratio of 20:80, weight average molecular weight of 40,000): | 36 parts by weight |
| Carbon black VXC72 (trade name, manufactured by Cabot Corporation): | 4 parts by weight |
| Toluene: | 250 parts by weight |
| Isopropyl alcohol: | 50 parts by weight |

The above components and glass beads (particle diameter: 1 mm, the same amount as the amount of toluene) are placed in a sand mill manufactured by Kansai Paint Co., Ltd., and stirred at a rotational speed of 1,200 rpm for 30 minutes, to prepare coating liquid 2 having a solid content of 11%.

(Preparation of Carrier)

—Preparation of Carrier 1—

2,000 parts by weight of ferrite particles 1 are placed in a 5 L vacuum deairing type kneader, and then 560 parts by weight of the coating liquid 1 are added thereto. While stirring the mixture, the pressure is reduced to −200 mmHg under the temperature of 60° C., and the mixture is further mixed for 15 minutes. Thereafter, the temperature is elevated and the pressure is reduced, and the mixture is stirred and dried at 94° C. and −720 mmHg for 30 minutes. Thereby, coated particles are obtained. Then, the coated particles are sieved using a 75 μm mesh screen, to obtain carrier 1.

—Preparation of Carrier 2—

Preparation of carrier 2 is conducted in a manner substantially similar to that in the preparation of the carrier 1, except that the ferrite particles 1 in the preparation of the carrier 1 is changed to the ferrite particles 2 and the addition amount of the coating liquid is changed to 380 parts by weight.

—Preparation of Carrier 3—

Preparation of carrier 3 is conducted in a manner substantially similar to that in the preparation of the carrier 1, except that the ferrite particles 1 in the preparation of the carrier 1 is changed to the ferrite particles 3.

—Preparation of Carrier 4—

Preparation of carrier 4 is conducted in a manner substantially similar to that in the preparation of the carrier 1, except that the ferrite particles 1 in the preparation of the carrier 1 is changed to the ferrite particles 4.

—Preparation of Carrier 5—

Preparation of carrier 5 is conducted in a manner substantially similar to that in the preparation of the carrier 1, except that the ferrite particles 1 in the preparation of the carrier 1 is changed to the ferrite particles 5.

—Preparation of Carrier 6—

Preparation of carrier 6 is conducted in a manner substantially similar to that in the preparation of the carrier 1, except that the ferrite particles 1 in the preparation of the carrier 1 is changed to the ferrite particles 6 and the addition amount of the coating liquid is changed to 380 parts by weight.

—Preparation of Carrier 7—

Preparation of carrier 7 is conducted in a manner substantially similar to that in the preparation of the carrier 1, except that the ferrite particles 1 in the preparation of the carrier 1 is changed to the ferrite particles 7.

—Preparation of Carrier 8—

Preparation of carrier 8 is conducted in a manner substantially similar to that in the preparation of the carrier 1, except that the ferrite particles 1 in the preparation of the carrier 1 is changed to the ferrite particles 8.

—Preparation of Carrier 9—

Preparation of carrier 9 is conducted in a manner substantially similar to that in the preparation of the carrier 1, except that the ferrite particles 1 in the preparation of the carrier 1 is changed to the ferrite particles 9 and the addition amount of the coating liquid is changed to 380 parts by weight.

—Preparation of Carrier 10—

Preparation of carrier 10 is conducted in a manner substantially similar to that in the preparation of the carrier 1, except that the coating liquid 1 in the preparation of the carrier 1 is changed to the coating liquid 2.

The details on the ferrite particles (core materials) used in the carriers obtained are listed in the following Table 1.

TABLE 1

| No. | Temporary Calcination Temperature (° C.) | Grinding of Temporarily Calcined Substance: Diameter of Ground Particle (Average Particle Diameter) (μm) | Grinding of Temporarily Calcined Substance: Additive $SiO_2$ (g) | Grinding of Temporarily Calcined Substance: Additive PVA (% by weight) | Regular Calcination Temperature (° C.) | Regular Calcination Oxygen Concentration (% by volume) | BET Specific Surface Area ($m^2/g$) | Fluidity (sec/50 g) | Note |
|---|---|---|---|---|---|---|---|---|---|
| Ferrite Particles 1 | 900 | 1.8 | 15 | 0.5 | 1200 | 5.0 | 0.16 | 28 | Corresponding to Example |
| Ferrite Particles 2 | 890 | 2.0 | not added | 1.0 | 1220 | 4.8 | 0.12 | 28 | Corresponding to Example |
| Ferrite Particles 3 | 900 | 2.0 | 25 | 0.5 | 1180 | 5.0 | 0.20 | 28 | Corresponding to Example |
| Ferrite Particles 4 | 910 | 1.6 | 27 | 0.5 | 1220 | 5.0 | 0.16 | 26 | Corresponding to Example |
| Ferrite Particles 5 | 900 | 2.0 | 30 | 0.5 | 1200 | 5.0 | 0.16 | 30 | Corresponding to Example |
| Ferrite Particles 6 | 880 | 1.8 | not added | 2.0 | 1240 | 4.6 | 0.08 | 26 | Corresponding to Comparative Example |
| Ferrite Particles 7 | 920 | 2.2 | 25 | 0.5 | 1195 | 5.2 | 0.25 | 30 | Corresponding to Comparative Example |
| Ferrite Particles 8 | 900 | 2.5 | 20 | 0.5 | 1200 | 5.0 | 0.16 | 32 | Corresponding to Comparative Example |
| Ferrite Particles 9 | 890 | 2.0 | not added | 2.0 | 1220 | 5.0 | 0.12 | 24 | Corresponding to Comparative Example |

[Preparation of Toner]

(Preparation of Colorant Dispersion Liquid 1)

| | |
|---|---|
| Cyan pigment: copper phthalocyanine B15:3 (manufactured by Dainichiseika Color & Chemicals Mfg. Co., Ltd.): | 50 parts by weight |

-continued

| | |
|---|---|
| Anionic surfactant: NEOGEN SC (trade name, manufactured by Dai-ichi Kogyo Seiyaku Co., Ltd.): | 5 parts by weight |
| Ion exchanged water: | 200 parts by weight |

The above components are mixed, then dispersed for 5 minutes using ULTRA-TURRAX (trade name) manufactured by IKA Corporation, and then further dispersed for 10 minutes using an ultrasonic bath. Thereby, colorant dispersion liquid 1 having a solid content of 21% is obtained. The volume average particle diameter is measured using a particle size analyzer LA-700 (trade name) manufactured by Horiba Ltd. and is revealed to be 160 nm.

(Preparation of Release Agent Dispersion Liquid 1)

| | |
|---|---|
| Paraffin wax: HNP-9 (trade name, manufactured by Nippon Seiro Co., Ltd.): | 19 parts by weight |
| Anionic surfactant: NEOGEN SC (trade name, manufactured by Dai-ichi Kogyo Seiyaku Co., Ltd.): | 1 part by weight |
| Ion exchanged water: | 80 parts by weight |

The above components are mixed in a heat resistant vessel, and heated to 90° C., followed by stirring for 30 minutes. Subsequently, the resulting melt liquid is flown from the bottom of the vessel to a Gaulin Homogenizer, and processed by a cycle operation corresponding to three paths under the pressure condition of 5 MPa. Then, the pressure is raised to 35 MPa, and the resulting liquid is further processed by a cycle operation corresponding to three paths. The emulsified liquid thus obtained is cooled in the heat resistant vessel until the temperature becomes 40° C. or lower. In this way, release agent dispersion liquid 1 is obtained. The volume average particle diameter is measured using a particle size analyzer LA-700 (trade name) manufactured by Horiba Ltd. and is revealed to be 240 nm.

(Preparation of Resin Dispersion Liquid 1)

| Oil Layer | |
|---|---|
| Styrene (manufactured by Wako Pure Chemical Industries, Ltd.): | 30 parts by weight |
| n-Butyl acrylate (manufactured by Wako Pure Chemical Industries, Ltd.): | 10 parts by weight |
| β-Carboxyethyl acrylate (manufactured by Rhodia Nicca Ltd.): | 1.3 parts by weight |
| Dodecanethiol (manufactured by Wako Pure Chemical Industries, Ltd.): | 0.4 parts by weight |
| **Water Layer 1** | |
| Ion exchanged water: | 17 parts by weight |
| Anionic surfactant (trade name: DOWFAX, manufactured by The Dow Chemical Company): | 0.4 parts by weight |
| **Water Layer 2** | |
| Ion exchanged water: | 40 parts by weight |
| Anionic surfactant (trade name: DOWFAX, manufactured by The Dow Chemical Company): | 0.05 parts by weight |
| Ammonium peroxodisulfate (manufactured by Wako Pure Chemical Industries, Ltd.): | 0.4 parts by weight |

The components of the above oil layer and the components of the above water layer 1 are placed in a flask, and mixed by stirring to obtain a monomer emulsified dispersion liquid. The components of the above water layer 2 are charged in a reaction vessel, the atmosphere inside the reaction vessel is sufficiently substituted with nitrogen, and the reaction system is heated in an oil bath, while stirring, until the temperature of the reaction system becomes 75° C. Then, to the reaction vessel, the above monomer emulsified dispersion liquid is gradually added dropwise over 3 hours, to perform emulsion polymerization. After completion of the addition, the polymerization is further continued at 75° C., and 3 hours later, the polymerization is finished.

The volume average particle diameter D50v of the obtained resin particles is measured using a laser diffraction type particle size distribution analyzer (trade name: LA-700, manufactured by Horiba Ltd.), and is revealed to be 250 nm. The glass transition temperature of the resin is measured at a temperature elevating speed of 10° C./min, using a differential scanning calorimeter (trade name: DSC-50, manufactured by Shimadzu Corporation), and is revealed to be 52° C. The number average molecular weight (in terms of polystyrene) of the resin is measured using a molecular weight measuring device (trade name: HLC-8020, manufactured by Tosoh Corporation) and using THE (tetrahydrofuran) as a solvent, and is revealed to be 13,000. Thus, a resin particle dispersion liquid having a volume average particle diameter of 250 nm, a solid content of 42%, a glass transition temperature of 52° C., and a number average molecular weight Mn of 13,000 is obtained.

(Preparation of Toner 1)

| | |
|---|---|
| Resin particle dispersion liquid 1: | 150 parts by weight |
| Colorant dispersion liquid 1: | 30 parts by weight |
| Release agent dispersion liquid 1: | 40 parts by weight |
| Poly aluminum chloride: | 0.4 parts by weight |

The above components are placed in a stainless steel flask, and are sufficiently mixed and dispersed using ULTRA-TURRAX (trade name) manufactured by IKA Corporation. Thereafter, the flask is heated in an oil bath for heating until the temperature becomes 48° C., while stirring. After maintaining the resulting dispersion liquid at 48° C. for 80 minutes, 70 parts by weight of the same resin particle dispersion liquid as the resin particle dispersion liquid described above are gradually added thereto.

Thereafter, the pH of the system is adjusted to 6.0 using a 0.5 mol/L aqueous solution of sodium hydroxide. Then, the stainless steel flask is sealed and the stirring axis is sealed using a magnetic seal. The reaction system is heated to 97° C. under continuous stirring, and left at that temperature for 3 hours. After completion of the reaction, the resulting product is cooled at a temperature lowering speed of 1° C./min, then filtered and sufficiently washed with ion exchanged water. Thereafter, solid-liquid separation is conducted by Nutsche type suction filtration.

The obtained product is re-dispersed using 3 L of ion exchanged water set at 40° C., and stirred and washed at 300 rpm for 15 minutes. This washing operation is further repeated for 5 times. When the pH of the filtrate becomes 6.54, and the electric conductivity of the filtrate becomes 6.5 μS/cm, solid-liquid separation is conducted by Nutsche type suction filtration using a No. 5A filter paper.

Subsequently, vacuum drying is performed continuously for 12 hours, thereby obtaining toner particles.

The volume average particle diameter D50v of the toner particles is measured using a Coulter counter, and is revealed to be 6.2 μm. The volume average particle size distribution index GSDv is revealed to be 1.20. Shape observation is performed by using LUZEX IMAGE ANALYZER (trade name) manufactured by Nireco Corporation, and the shape factor SF1 of the particles is revealed to be 135, which indicates that the particles are potato-like shaped particles. The glass transition temperature of the toner particles is 52° C.

Moreover, to the toner particles, silica ($SiO_2$) particles having an average primary particle diameter of 40 nm, which have been subjected to a surface hydrophobizing treatment by using hexamethyldisilazane (hereinafter, may be abbreviated to "HMDS" in some cases), and metatitanic acid compound particles having an average primary particle diameter of 20 nm, which are particles of a reaction product of metatitanic acid and isobutyltrimethoxysilane, are added so that the coating ratio with respect to the toner particle surface becomes 40%. The mixture is mixed using a HENSCHEL MIXER. Thereby, toner 1 is prepared.

Examples 1 to 6, and Comparative Examples 1 to 4

The carrier 1 to 10 and the toner are mixed so that the toner concentration becomes 6% by weight, whereby respective developers are obtained.

The developer thus obtained is charged in a modified machine of DOCUCENTRE COLOR 400 (trade name) manufactured by Fuji Xerox Co., Ltd. (modified so that the cyan developing unit can be independently controlled). Blank image output (namely, output in which the toner consumption is zero) is carried out with 100 sheets of paper, under the conditions of 20° C. and 15% RH. Thereafter, the developer used is left for 4 days under an environment of 30° C. and 88% RH. After leaving, adjustment of electric potential is not performed, and blank image output with one sheet of paper is carried out under the condition in which the electric potential parameter is kept as it is at the value after completion of the last 100 sheets output.

With regard to the outputted paper sheet of the blank image output, the occurrence of fog is visually observed and evaluated.

The evaluation criteria are as follows.

A: Fog is not visually observed, that is good.

B: Fog can be slightly recognized visually, that is good.

C: Fog can be recognized visually, that is good.

D: Fog is observed over the entire surface.

E: Fog is remarkably observed over the entire surface.

TABLE 2

| No. | Carrier No. | Ferrite Particles No. | Coating Resin Layer (Coating Liquid No.) | Toner No. | Fog |
|---|---|---|---|---|---|
| Example 1 | 1 | 1 | 1 | 1 | A |
| Example 2 | 2 | 2 | 1 | 1 | B |
| Example 3 | 3 | 3 | 1 | 1 | B |
| Example 4 | 4 | 4 | 1 | 1 | C |
| Example 5 | 5 | 5 | 1 | 1 | B |
| Example 6 | 10 | 1 | 2 | 1 | B |
| Comparative Example 1 | 6 | 6 | 1 | 1 | D |
| Comparative Example 2 | 7 | 7 | 1 | 1 | E |
| Comparative Example 3 | 8 | 8 | 1 | 1 | D |
| Comparative Example 4 | 9 | 9 | 1 | 1 | D |

From the above results, it is understood that the occurrence of fog is suppressed in the Examples as compared with the Comparative Examples.

Further, when comparing Examples 1 and 6, the occurrence of fog is suppressed in Example 1, in which an acrylic resin having a cyclohexyl group is used as the coating resin, as compared with Example 6.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments are chosen and described in order to best explain the principles of the invention and its practical applications, thereby enabling others skilled in the art to understand the invention for various embodiments and with the various modifications as are suited to the particular use contemplated.

What is claimed is:

1. A developer for developing an electrostatic charge image, the developer comprising:

a toner, wherein the toner comprises a binder resin having a softening temperature (Tm) of from about 80° C. to about 100° C.; and a carrier, wherein the carrier comprises ferrite particles having a Brunauer-Emmitt-Teller (BET) specific surface area of from about 0.12 $m^2/g$ to about 0.20 $m^2/g$, and a fluidity of from about 26 sec/50 g to about 30 sec/50 g, and a coating resin layer that covers the ferrite particles and comprises an acrylic resin having a cyclohexyl group, the cyclohexyl group being included in the coating resin layer in an amount of about 80% by weight with respect to the acrylic resin.

2. The developer according to claim 1, wherein the ferrite particles comprise a ferrite represented by the following formula:

$$(MO)_X(Fe_2O_3)_Y$$

where

M represents at least one selected from the group consisting of Mn, Li, Ca, Sr, Sn, Cu, Zn, Ba, Mg and Ti, and X and Y each represent a mole ratio and X+Y=100.

3. The developer according to claim 1, wherein the ferrite particles have an average particle diameter in a range of from about 30 μm to about 90 μm.

4. The developer according to claim 1, wherein the ferrite particles have a volume resistivity in a range of from about $1.0\times10^5$ Ωcm to about $1.0\times10^8$ Ωcm under an electric field of 15,000 V/cm.

5. The developer according to claim 1, wherein the ferrite particles have a saturation magnetization of about 40 emu/g or more in a magnetic field of 1,000 Oe.

6. The developer according to claim 1, wherein the ferrite particles have a surface that has been subjected to a coupling treatment.

7. The developer according to claim 1, wherein the ferrite particles are obtained from a raw material in which an amount of impurities is about 100 ppm or less by weight with respect to a total amount of the raw material.

8. The developer according to claim 1, wherein the acrylic resin having a cyclohexyl group is formed using at least cyclohexyl acrylate or cyclohexyl methacrylate.

9. The developer according to claim 1, wherein a resin included in the coating resin layer has a weight average molecular weight of from about 5,000 to about 1,000,000.

10. The developer according to claim 1, wherein the coating resin layer is coated at an amount of from about 0.5 parts by weight to about 10 parts by weight with respect to 100 parts by weight of the ferrite particles.

11. The developer according to claim 1, wherein the coating resin layer has a coating ratio on a surface of the ferrite particles of about 80% or higher.

12. The developer according to claim 1, wherein the binder resin has a weight average molecular weight (Mw) of from about 9,000 to about 90,000.

13. The developer according to claim 1, wherein the binder resin has a glass transition temperature (Tg) of from about 45° C. to about 70° C.

14. The developer according to claim 1, wherein the toner further comprises a release agent having a melting point of from about 40° C. to about 150° C., and a content of the release agent is in a range of from about 1% by weight to about 10% by weight with respect to a total content of components of the toner.

15. An image forming method, comprising:

charging an image holding body;

forming an electrostatic charge image on a surface of the charged image holding body;

developing an electrostatic charge image formed on the image holding body to provide a toner image using the developer according to claim 1;

transferring the toner image formed on the image holding body onto a transfer medium; and fixing the toner image that has been transferred onto the transfer medium.

16. The developer according to claim 1, wherein the ferrite particles have a Brunauer-Emmitt-Teller (BET) specific surface area of from about 0.14 $m^2/g$ to about 0.18 $m^2/g$.

17. The developer according to claim 1, wherein the ferrite particles have a fluidity of from about 27 sec/50 g to about 30 sec/50 g.

* * * * *